US011299968B2

(12) United States Patent
Costa de Oliveira et al.

(10) Patent No.: US 11,299,968 B2
(45) Date of Patent: Apr. 12, 2022

(54) REDUCING WELLBORE ANNULAR PRESSURE WITH A RELEASE SYSTEM

(71) Applicant: Saudi Arabian Oil Company, Dhahran (SA)

(72) Inventors: Victor Carlos Costa de Oliveira, Dhahran (SA); Khaled K. Abouelnaaj, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/841,407

(22) Filed: Apr. 6, 2020

(65) Prior Publication Data

US 2021/0310319 A1 Oct. 7, 2021

(51) Int. Cl.

| | |
|---|---|
| ***E21B 43/12*** | (2006.01) |
| ***E21B 21/08*** | (2006.01) |
| ***E21B 21/10*** | (2006.01) |
| ***E21B 34/06*** | (2006.01) |
| ***E21B 47/06*** | (2012.01) |

(52) U.S. Cl.

CPC ..... *E21B 43/12* (2013.01); *E21B 21/08* (2013.01); *E21B 21/103* (2013.01); *E21B 34/06* (2013.01); *E21B 47/06* (2013.01)

(58) Field of Classification Search

CPC ..... E21B 21/08; E21B 34/06; E21B 21/103; E21B 47/06; E21B 34/08; E21B 34/066

See application file for complete search history.

(56) References Cited

U.S. PATENT DOCUMENTS

| | | | |
|---|---|---|---|
| 1,812,044 | A | 6/1931 | Grant |
| 2,169,502 | A | 8/1939 | Santiago |
| 2,499,916 | A | 3/1950 | Harris |
| 2,743,083 | A | 4/1956 | Zublin |
| 2,967,048 | A | 1/1961 | Alphones |
| 3,335,801 | A | 8/1967 | Wilsey |
| 3,425,500 | A | 2/1969 | Fuchs |
| 3,483,934 | A | 12/1969 | Fuchs |

(Continued)

FOREIGN PATENT DOCUMENTS

| | | |
|---|---|---|
| CN | 204177988 | 2/2015 |
| EP | 0377234 | 10/1989 |

(Continued)

OTHER PUBLICATIONS

"TIW Xpak Liner Hanger System," Engineering Innovation Worldwide, TIW: A Pearce Industries Company, retrieved from URL <http://www.tiwoiltools.com/Images/Interior/downloads/tiw_xpak_brochure.pdf>, 2015, 4 pages.

(Continued)

*Primary Examiner* — Brad Harcourt

(74) *Attorney, Agent, or Firm* — Fish & Richardson P.C.

(57) ABSTRACT

A system and a method for reducing annular pressure with a casing annulus pressure release system are described. The casing annulus pressure release system includes a controller, multiple sensors, and a pressure release sub-system disposed a wellbore annulus. The sensors sense wellbore conditions in the annular space and transmit signals representing the sensed wellbore conditions to the controller. The pressure release subsystem releases pressure in the annular space into the wellbore in response to a signal from the controller.

18 Claims, 5 Drawing Sheets

(56) References Cited

U.S. PATENT DOCUMENTS 3,557,875 A 1/1971 Solum et al.
4,058,163 A 11/1977 Yandell
4,252,195 A 2/1981 Fredd
4,384,625 A 5/1983 Roper et al.
4,399,873 A 8/1983 Lindsey, Jr.
4,458,761 A 7/1984 Van Vreeswyk
4,482,014 A 11/1984 Allwin et al.
4,646,842 A 3/1987 Arnold et al.
4,667,742 A 5/1987 Bodine
4,674,569 A 6/1987 Revils et al.
4,681,159 A 7/1987 Allwin et al.
4,693,328 A 9/1987 Furse et al.
4,846,290 A 7/1989 Jones
4,852,654 A 8/1989 Buckner
4,855,820 A 8/1989 Barbour
4,890,682 A 1/1990 Worall et al.
4,944,348 A 7/1990 Whiteley et al.
4,993,493 A 2/1991 Arnold
5,152,342 A 10/1992 Rankin et al.
5,390,742 A 2/1995 Dines et al.
5,515,922 A 5/1996 Ruttley
5,582,247 A 12/1996 Brett et al.
5,715,891 A 2/1998 Graham
5,771,985 A 6/1998 Jaworski
5,831,156 A 11/1998 Mullins
5,875,852 A 3/1999 Floyd et al.
5,947,213 A 9/1999 Angle
6,009,948 A 1/2000 Flanders et al.
RE36,556 E 2/2000 Smith
6,105,669 A 8/2000 Davis
6,142,244 A 11/2000 Hesse
6,152,221 A 11/2000 Carmicheal et al.
6,163,257 A 12/2000 Tracy
6,234,250 B1 5/2001 Green et al.
6,378,628 B1 4/2002 McGuire et al.
6,527,066 B1 3/2003 Rives
6,550,534 B2 4/2003 Brett
6,577,244 B1 6/2003 Clark et al.
6,588,505 B2 7/2003 Beck et al.
6,629,564 B1 * 10/2003 Ramakrishnan ..... E21B 47/10 166/250.07
6,662,110 B1 12/2003 Bargach et al.
6,684,953 B2 2/2004 Sonnier
6,691,779 B1 2/2004 Sezginer et al.
6,739,398 B1 5/2004 Yokley et al.
6,752,216 B2 6/2004 Coon
6,873,267 B1 3/2005 Tubel et al.
6,899,178 B2 5/2005 Tubel
6,938,698 B2 9/2005 Coronado
6,978,840 B2 * 12/2005 Henderson ..... E21B 34/14 166/296
7,219,730 B2 5/2007 Tilton et al.
7,228,902 B2 6/2007 Oppelt
7,243,735 B2 7/2007 Koederitz et al.
7,252,152 B2 8/2007 LoGiudice et al.
7,278,492 B2 10/2007 Braddick
7,419,001 B2 9/2008 Broussard
7,581,440 B2 9/2009 Meek
7,654,334 B2 2/2010 Manson
7,665,537 B2 2/2010 Patel et al.
7,677,303 B2 3/2010 Coronado
7,690,432 B2 4/2010 Noske et al.
7,938,192 B2 5/2011 Rytlewski
7,940,302 B2 5/2011 Mehrotra et al.
8,028,767 B2 10/2011 Radford et al.
8,102,238 B2 1/2012 Golander et al.
8,191,635 B2 6/2012 Buske et al.
8,237,585 B2 8/2012 Zimmerman
8,334,775 B2 12/2012 Tapp et al.
8,424,605 B1 4/2013 Schultz et al.
8,448,724 B2 5/2013 Buske et al.
8,469,084 B2 6/2013 Clark et al.
8,528,668 B2 9/2013 Rasheed
8,540,035 B2 9/2013 Xu et al.
8,607,818 B2 12/2013 Monroe et al.
8,733,469 B2 5/2014 Konschuh
8,750,513 B2 6/2014 Renkis
8,789,585 B2 7/2014 Leising et al.
8,800,655 B1 8/2014 Bailey
8,833,472 B2 9/2014 Hay
8,919,431 B2 12/2014 Lott
8,925,213 B2 1/2015 Sallwasser
8,967,272 B2 3/2015 Mock et al.
8,991,489 B2 3/2015 Redlinger et al.
9,038,718 B1 5/2015 Karimi
9,051,792 B2 6/2015 Herberg et al.
9,091,148 B2 7/2015 Moffitt et al.
9,121,255 B2 9/2015 Themig et al.
9,133,666 B2 9/2015 Lee
9,140,100 B2 9/2015 Daccord et al.
9,157,294 B2 10/2015 Kleppa et al.
9,187,959 B2 11/2015 Treviranus et al.
9,208,676 B2 12/2015 Fadell et al.
9,222,312 B2 12/2015 Anderson
9,341,027 B2 5/2016 Radford et al.
9,494,003 B1 11/2016 Carr
9,506,318 B1 11/2016 Brunet
9,546,536 B2 1/2017 Schultz et al.
9,598,923 B2 3/2017 Gilleylen
9,963,960 B2 5/2018 Tolman et al.
2002/0053434 A1 5/2002 Chen et al.
2002/0070018 A1 6/2002 Buyaert
2002/0148607 A1 10/2002 Pabst
2003/0001753 A1 1/2003 Cernocky et al.
2004/0060741 A1 4/2004 Shipalesky et al.
2004/0069496 A1 4/2004 Hosie et al.
2004/0134687 A1 7/2004 Radford et al.
2004/0156264 A1 8/2004 Gardner et al.
2004/0168800 A1 9/2004 Sask
2005/0092488 A1 5/2005 Rodet et al.
2005/0273302 A1 12/2005 Huang et al.
2006/0081375 A1 4/2006 Ruttley
2006/0086497 A1 4/2006 Ohmer et al.
2006/0107061 A1 5/2006 Holovacs
2006/0260799 A1 11/2006 Broussard
2006/0290528 A1 12/2006 MacPherson et al.
2007/0057811 A1 3/2007 Mehta
2007/0107911 A1 5/2007 Miller et al.
2007/0187112 A1 8/2007 Eddison et al.
2007/0261855 A1 11/2007 Brunet
2008/0041631 A1 2/2008 Vail, III
2008/0115574 A1 5/2008 Meek
2009/0045974 A1 2/2009 Patel
2009/0050333 A1 2/2009 Smith
2009/0114448 A1 5/2009 Laird et al.
2009/0145666 A1 6/2009 Radford et al.
2009/0188718 A1 7/2009 Kaageson-Loe et al.
2009/0223670 A1 9/2009 Snider
2009/0289808 A1 11/2009 Prammer
2009/0301723 A1 12/2009 Gray
2010/0051287 A1 3/2010 Moraes
2010/0097205 A1 4/2010 Script
2010/0101786 A1 4/2010 Lovell et al.
2010/0122811 A1 5/2010 Maskos et al.
2010/0139981 A1 6/2010 Meister et al.
2010/0212891 A1 8/2010 Stewart et al.
2010/0212900 A1 8/2010 Eddison et al.
2010/0212901 A1 8/2010 Buytaert
2010/0258297 A1 10/2010 Lyndre
2010/0258298 A1 10/2010 Lynde et al.
2010/0282511 A1 11/2010 Maranuk et al.
2011/0031023 A1 2/2011 Menezes et al.
2011/0067884 A1 3/2011 Burleson et al.
2011/0073329 A1 3/2011 Clemens et al.
2011/0100645 A1 5/2011 Yapici
2011/0114333 A1 5/2011 Fenton
2011/0127044 A1 6/2011 Radford et al.
2011/0147014 A1 6/2011 Chen et al.
2011/0240302 A1 10/2011 Coludrovich, III
2011/0266004 A1 11/2011 Hallundbaek et al.
2012/0048571 A1 3/2012 Radford et al.
2012/0048619 A1 3/2012 Seutter
2012/0085540 A1 4/2012 Heijnen
2012/0175135 A1 7/2012 Dyer et al.

(56) References Cited

U.S. PATENT DOCUMENTS

| | | | |
|---|---|---|---|
| 2012/0211229 | A1 | 8/2012 | Fielder |
| 2012/0211280 | A1 | 8/2012 | Dewey et al. |
| 2012/0241154 | A1 | 9/2012 | Zhou |
| 2012/0247767 | A1 | 10/2012 | Themig et al. |
| 2012/0307051 | A1 | 12/2012 | Welter |
| 2012/0312560 | A1 | 12/2012 | Bahr et al. |
| 2013/0128697 | A1 | 5/2013 | Contant |
| 2013/0153245 | A1 | 6/2013 | Knobloch et al. |
| 2013/0186645 | A1 | 7/2013 | Hall |
| 2013/0292175 | A1 | 11/2013 | Radford et al. |
| 2013/0299160 | A1 | 11/2013 | Lott |
| 2014/0060844 | A1 | 3/2014 | Barbour et al. |
| 2014/0083769 | A1 | 3/2014 | Moriarty et al. |
| 2014/0090898 | A1 | 4/2014 | Moriarty et al. |
| 2014/0126330 | A1 | 5/2014 | Shampine et al. |
| 2014/0131036 | A1 | 5/2014 | Huval et al. |
| 2014/0139681 | A1 | 5/2014 | Jones, Jr. et al. |
| 2014/0166367 | A1 | 6/2014 | Campbell et al. |
| 2014/0172306 | A1 | 6/2014 | Brannigan |
| 2014/0208847 | A1 | 7/2014 | Baranov |
| 2014/0308203 | A1 | 10/2014 | Sheinberg et al. |
| 2015/0027706 | A1 | 1/2015 | Symms |
| 2015/0090459 | A1 | 4/2015 | Cain et al. |
| 2015/0101863 | A1 | 4/2015 | Jeffryes |
| 2015/0101864 | A1 | 4/2015 | May |
| 2015/0152713 | A1 | 6/2015 | Garcia et al. |
| 2015/0152715 | A1* | 6/2015 | Cunningham ..... E21B 43/10 166/250.01 |
| 2015/0176362 | A1 | 6/2015 | Prieto et al. |
| 2015/0226009 | A1 | 8/2015 | Claudey et al. |
| 2015/0267500 | A1 | 9/2015 | Van Dongen et al. |
| 2015/0308203 | A1 | 10/2015 | Lewis |
| 2016/0160578 | A1 | 6/2016 | Lee |
| 2016/0215612 | A1 | 7/2016 | Morrow |
| 2016/0230508 | A1 | 8/2016 | Jensen |
| 2016/0237764 | A1 | 8/2016 | Jellison et al. |
| 2016/0237768 | A1 | 8/2016 | Jamison et al. |
| 2016/0245039 | A1 | 8/2016 | Goodman et al. |
| 2016/0356133 | A1 | 12/2016 | Hamid et al. |
| 2016/0356152 | A1 | 12/2016 | Croux |
| 2017/0044834 | A1 | 2/2017 | Peters |
| 2017/0067318 | A1 | 3/2017 | Haugland |
| 2017/0074071 | A1 | 3/2017 | Tzallas et al. |
| 2017/0159365 | A1 | 6/2017 | Solem |
| 2017/0191919 | A1 | 7/2017 | Kulkarni |
| 2017/0292328 | A1 | 10/2017 | Swinford |
| 2018/0030810 | A1 | 2/2018 | Saldanha |
| 2019/0020702 | A1 | 1/2019 | Selekman et al. |
| 2019/0040703 | A1 | 2/2019 | Costa De Oliveira et al. |
| 2019/0226291 | A1 | 7/2019 | Lewis et al. |
| 2019/0292896 | A1 | 9/2019 | Costa De Oliveira et al. |

FOREIGN PATENT DOCUMENTS

| | | |
|---|---|---|
| EP | 0618345 | 10/1994 |
| EP | 1241321 | 9/2002 |
| EP | 2157278 | 2/2010 |
| EP | 2692982 | 5/2014 |
| EP | 2835493 | 2/2015 |
| GB | 2157743 | 10/1985 |
| GB | 2194571 | 3/1988 |
| GB | 2261238 | 12/1993 |
| GB | 2414257 | 11/2005 |
| GB | 2460096 | 11/2009 |
| GB | 2470762 | 12/2010 |
| WO | WO 2003058545 | 7/2003 |
| WO | WO 2011038170 | 3/2011 |
| WO | WO 2011095600 | 8/2011 |
| WO | WO 2011159890 | 12/2011 |
| WO | WO 2014100266 | 6/2014 |
| WO | WO 2015169959 | 11/2015 |
| WO | WO 2016007139 | 1/2016 |
| WO | WO 2016060658 | 4/2016 |

OTHER PUBLICATIONS

Engineersedge.com [online], "American National Standard Stub Acme Single-Start Screw Threads Table Chart, ASME/ANSI B1.8-1988 (R2001)," Machinery's Handbook, 29th Edition, retrieved on Feb. 27, 2017, retrieved from URL: <http://www.engineersedge.com/hardware/acme-stub-thread.htm>, 2001-2017, 2 pages.

Offshore-mag.com [online], "Completions Technology: Large monobore completions prevent high-volume gas well flow restrictions," retrieved on Feb. 27, 2017, retrieved from URL: <http://www.offshore-mag.com/articles/print/volume-61/issue-12/news/completions-technology-large-monobore-completions-prevent-high-volume-gas-well-flow-restrictions.html>, Dec. 1, 2001, 9 pages.

slb.com [online], "Intelligent Fluids Monitoring System: Automated analysis of critical parameters in challenging and remote applications," retrieved on May 1, 2018, retrieved from URL: <https://www.slb.com/resources/other_resources/brochures/miswaco/intelligent_fluids_monitoring_brochure.aspx>, available on or before Mar. 11, 2015, 8 pages.

PCT Invitation to Pay Additional Fees and, Where Applicable, Protest Fee in International Appln. No. PCT/US2021/025978, dated Jul. 20, 2021.

PCT International Search Report and Written Opinion in International Appln. No. PCT/US2021/025978, dated Sep. 10, 2021.

* cited by examiner

REDUCING WELLBORE ANNULAR PRESSURE WITH A RELEASE SYSTEM

TECHNICAL FIELD

This disclosure relates to managing annular pressure in downhole regions of a wellbore during wellbore operations in an oil and gas well.

BACKGROUND

Wellbores in an oil and gas well are filled with both liquid and gaseous phases of various fluids and chemicals including water, oils, and hydrocarbon gases. Some wellbores or portions of wellbores are open to the Earth. The Earth consists of multiple geological formations physically separated into layers. The geological formations can contain the water, oils, and hydrocarbon gases at different pressures. Wellbores can contain casings with an inner annular region. The casing in the wellbore creates an outer annular region with the wall of the wellbore. The wall of the wellbore can be another casing. Pressure differences between the inner annular region and the outer annular region fluctuate based on many factors such as unexpected fluid flows, casing failures, cement failures, or equipment damage. In some cases, a pressure difference between the inner annular region and outer annular region can cause casing failure.

SUMMARY

This disclosure describes technologies related to reducing wellbore annular pressure with a release system.

Implementations of the present disclosure include a casing annulus pressure release system. The casing annulus pressure release system includes a controller, multiple sensors, and a pressure release sub-system. The controller is configured to be disposed in an annular space. The annular space is defined by positioning an inner hollow member of a wellbore within an outer hollow member of the wellbore. The sensors are configured to be disposed in the annular space. The sensors are operatively coupled to the controller. The sensors are configured to sense wellbore conditions in the annular space and transmit signals representing the sensed wellbore conditions to the controller. The pressure release sub-system is configured to be disposed in the annular space. The pressure release sub-system is operatively coupled to the controller. The pressure release subsystem is configured to release pressure in the annular space into the inner hollow member of the wellbore through a circumferential wall of the inner hollow member responsive to a signal from the controller.

In some implementations, the inner hollow member is a casing and the outer hollow member is the wellbore.

In some implementations, the inner hollow member is an inner casing and the outer hollow member is an outer casing.

In some implementations, the casing annulus pressure release system includes a casing joint coupling the inner hollow member and the outer hollow member. The controller, the sensors, and the pressure release subsystem are positioned within the casing joint.

In some implementations, the casing joint controller, sensors, and the pressure release subsystem are positioned between an outer surface of the inner hollow member and an inner surface of the casing joint.

In some implementations, the sensors include a first pressure sensor configured to measure a pressure inside the outer hollow member.

In some implementations, the first pressure sensor is positioned within the casing joint and directly contacts an outer surface of the inner hollow member.

In some implementations, the sensors include a second sensor configured to measure an annular pressure in the annular space.

In some implementations, the second pressure sensor is positioned within the casing joint and directly contacts an inner surface of the casing joint.

In some implementations, the casing annulus pressure release system includes a power source configured to power the controller.

In some implementations, the pressure release subsystem includes a first conduit, a second conduit, and a dual seal. The first conduit fluidically connects the annular space to an internal volume defined by the casing joint. The second conduit fluidically connects the annular space to the internal volume defined by the casing joint to an internal volume defined by the inner hollow member. At least a portion of the second conduit is formed in the circumferential wall of the inner hollow member. The dual seal is positioned between the first conduit and the second conduit. The dual seal is configured to open or close fluid flow between the first conduit and the second conduit.

In some implementations, the pressure release subsystem includes a hydraulic fluid chamber to close or open the dual seal. Hydraulic fluid from the hydraulic fluid reservoir flows into or out of, respectively, the hydraulic fluid chamber.

In some implementations, the pressure release subsystem includes a hydraulic fluid reservoir and a hydraulic pump. The hydraulic fluid reservoir fluidically couples to the hydraulic fluid chamber carrying hydraulic fluid by a third conduit. The hydraulic fluid reservoir is configured to flow the hydraulic fluid to the hydraulic fluid chamber through the third conduit. The third conduit has a check valve configured to prevent back flow. Flowing hydraulic fluid from the hydraulic fluid reservoir to hydraulic fluid chamber causes the dual seal to close. The hydraulic pump fluidically couples the hydraulic fluid reservoir to the hydraulic fluid chamber. The hydraulic pump is configured to move hydraulic fluid from the hydraulic fluid chamber to the hydraulic fluid reservoir, opening the dual seal.

In some implementations, the hydraulic fluid chamber is configured to be flexible to set a threshold annular pressure. The hydraulic pump is configured to flow hydraulic fluid from the hydraulic fluid chamber to the hydraulic fluid reservoir at or above the threshold annular pressure. Flowing hydraulic fluid opens the dual seal to open fluid flow between the first conduit and the second conduit. Below the threshold annular pressure the hydraulic pump and the check valve are configured to prevent fluid exiting the hydraulic fluid chamber, stopping fluid flow between the first conduit and the second conduit.

In some implementations, the dual seal includes a metal-to-metal seal and an elastomeric seal. The metal-to-metal seal is configured to seal flow through the second conduit and the elastomeric seal is configured to seal flow through the first conduit independently from each other.

Implementations of the present disclosure include a method for reducing wellbore annular pressure with a release system. A first pressure is sensed in a first annular space defined by an inner hollow member of a wellbore within an outer hollow member of the wellbore. A first pressure signal is generated from the first pressure. A second pressure is sensed in a second annular space defined by the inner hollow member of the wellbore. A second pressure signal is generated from the second pressure. The first pressure signal and the second pressure signal are transmitted to a controller within the wellbore. The controller compares the first pressure signal to the second pressure signal. The controller generates a control signal when the first pressure signal exceeds the second pressure signal by a threshold value. The controller transmits the control signal to a pressure release sub-system configured to release pressure in the first annular space into the second annular space through a circumferential wall of the inner casing.

In some implementations, reducing wellbore annular pressure with a release system includes the pressure release sub-system receiving the control signal from the controller. The control signal opens a dual seal positioned between a first conduit fluidically coupled to the first annular space and the second conduit fluidically coupled to the second annular space. The dual seal is configured to open or close fluid flow between the first conduit and the second conduit. The dual seal includes a metal-to-metal seal and an elastomeric seal. The metal-to-metal seal is configured to seal flow through the second conduit and the elastomeric seal is configured to seal flow through the first conduit independently from each other. The pressure is released between the first annular space and the second annular space.

Implementations of the present disclosure include a pressure release system. The pressure release system includes a first conduit, a second conduit, a dual seal, a hydraulic fluid chamber, and a hydraulic fluid reservoir. The first conduit fluidically connects a first annular space defined by an outer casing of a wellbore to an internal volume defined by a casing joint. The second conduit fluidically connects a second annular space defined by an inner casing. The internal volume is defined by the casing joint to an internal volume defined by the inner casing. At least a portion of the second conduit is formed in the circumferential wall of the inner casing. The dual seal is positioned between the first conduit and the second conduit. The dual seal is configured to open or close fluid flow between the first conduit and the second conduit. The dual seal includes a metal-to-metal seal and an elastomeric seal. The metal-to-metal seal is configured to seal flow through the second conduit and the elastomeric seal is configured to seal flow through the first conduit independently from each other. The hydraulic fluid flows into or out of the hydraulic fluid chamber to close or open the dual seal, respectively. The hydraulic fluid reservoir is coupled to the hydraulic fluid chamber by a third conduit. The third conduit has a check valve. The check valve is configured to maintain closed or to close fluid flow between the first conduit and the second conduit responsive to the signal from the controller. The third conduit carries hydraulic fluid. The hydraulic fluid reservoir is configured to flow the hydraulic fluid to the check valve responsive to a signal to cause the check valve to close the fluid flow between the first conduit and the second conduit.

In some implementations, the pressure release system further includes a hydraulic pump fluidically coupled to the hydraulic fluid reservoir and the hydraulic fluid chamber. The hydraulic pump is configured to move hydraulic fluid from the hydraulic fluid reservoir and the hydraulic fluid chamber, opening the dual seal.

In some implementations, the hydraulic fluid chamber is flexible to set a threshold annular pressure at or above which the hydraulic pump is configured to open fluid flow between the first conduit and the second conduit and below which the check valve is configured to close fluid flow between the first conduit and the second conduit.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
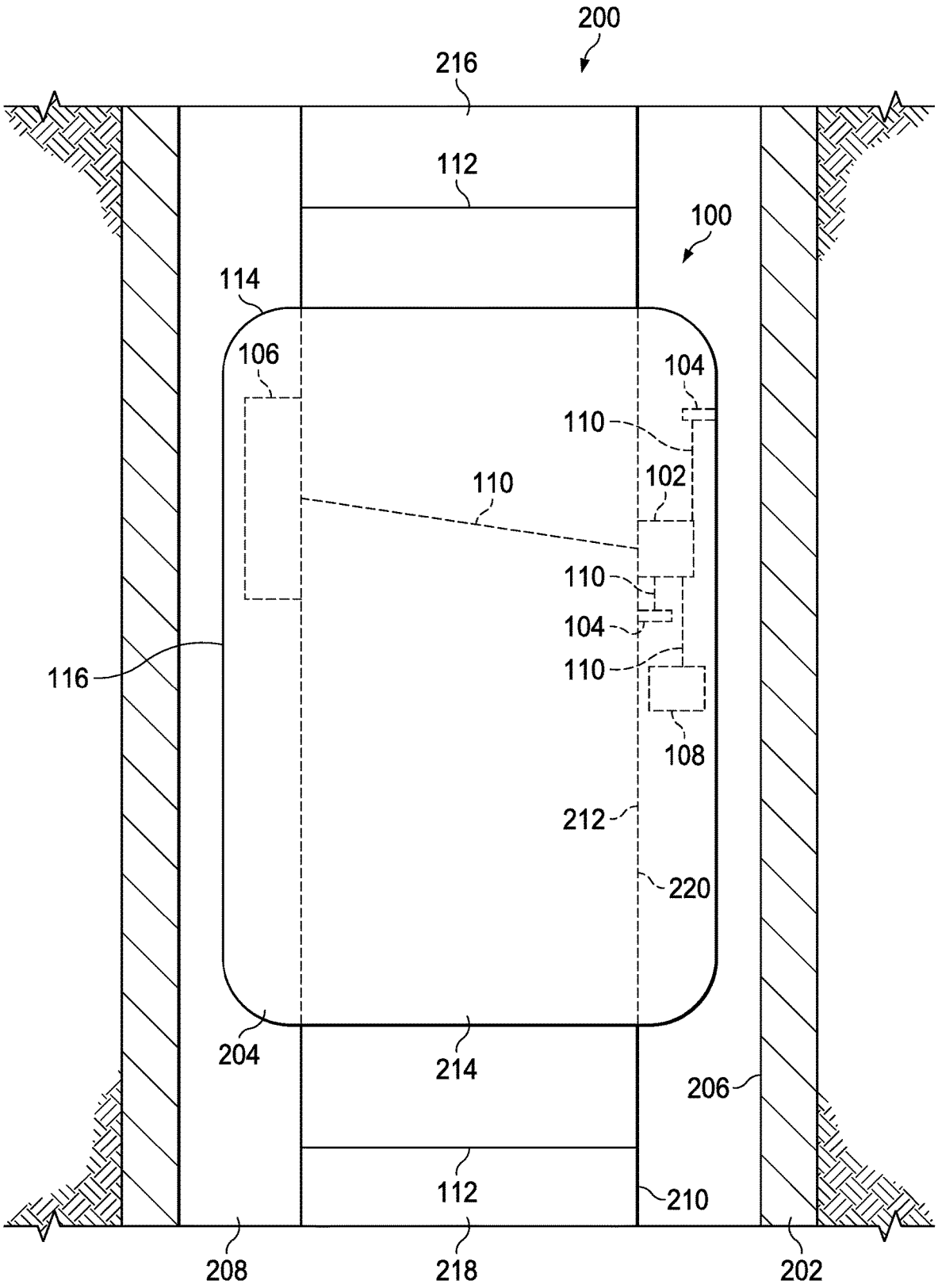
FIG. 1 is a schematic view of a casing annular pressure release system.

The present disclosure describes a system and a method for reducing annular pressure with a casing annulus pressure release system. The casing annulus pressure release system includes a casing joint interposed between two casings in a wellbore. The casing defines an inner void. The casing and the wellbore or another casing define an outer void. A first casing disposed within a second casing or wellbore defines an annulus between the first casing and the second casing or wellbore. An annulus is a ring-like hollow void between two bodies which can contain a fluid or gas. The fluid or gas may flow within the annulus from one location to another location. Differing casing sections are exposed to different geological formations within the Earth. Fluid pressures differ between formations. Drilling a wellbore connects the different geological formations. Placing the casing in the wellbore and cementing the casing in the wellbore provide a pressure boundary. In some cases, pressure can build up in a formation, resulting in an overpressure condition exceeding casing capacity. In other cases, a casing and cement can fail, resulting in an overpressure condition exceeding a subsequent casing capacity. The casing annulus pressure release system alleviates these detrimental effects.

The casing annulus pressure release system measures pressure in the annulus and compares the measured pressure with a threshold pressure. Based on a result of the comparison, the system bleeds some or all of the annular pressure into an inner casing. At other times, the system seals the annular space to maintain the pressure.

Implementations of the present disclosure realize one or more of the following advantages. For example, casing integrity is improved. In the event of an overpressure condition, the pressure is released through a designed flow path, protecting casing structural integrity. Otherwise, if the overpressure condition was not able to be released through the designed flow path, the casing or cement could rupture causing a catastrophic failure. For example, communication of downhole conditions to the surface is improved. Casing, pipe, or cement leaking is more closely monitored due to the proximity of additional sensors to downhole conditions. Some downhole conditions or regions which could not be monitored at the surface due to the particular well construction design, can now be monitored in real time. For example, well construction operations like cementing are monitored in real time. The casing annulus pressure release system confirms the setting of the cement by monitoring pressure parametric changes between the inner annular region and the outer annular region. Proper setting forces are monitored to ensure a good cement set. For example, in an overpressure condition, confirmation of full pressure release is available when pressure parameters return to normal a normal pressure range. For example, monitoring of gas migration between casing joints is available due to additional downhole sensors to monitor pressures in the wellbore.

FIG. 1 shows a casing annulus pressure release system 100 disposed in the wellbore casing system 200 according to the implementations of the present disclosure. The casing annulus pressure release system includes a controller disposed in the outer annular space. The controller is operatively coupled to multiple sensors and a pressure release sub-system. Multiple sensors are disposed in the inner and the outer annular spaces. Multiple sensors sense wellbore conditions in the inner annular space and the outer annular space and transmit signals representing the sensed wellbore conditions to the controller. The pressure release sub-system releases pressure in the outer annular space into the inner annular space through a circumferential wall of the casing in response to a signal from the controller.

The wellbore casing system 200 includes a wellbore where the casing annulus pressure release system 100 is positioned. The wellbore casing system 200 has an outer hollow member 202 and an inner hollow member 204. In some implementations, the outer hollow member 202 is a casing. A casing can be steel or cement. A steel or cement casing can be a casing, a casing joint, or an elongated tubular member through which wellbore fluid flows. A steel or cement casing is capable of withstanding well conditions and well fluid pressures. In other implementations, the outer hollow member 202 is a production tubing or a drill pipe. The outer hollow member 202 has an inner surface 206. The inner surface 206 defines an inner void 208. In some implementations, the inner hollow member 204 is a casing. In other implementations, the inner hollow member 204 is a production tubing or a drill pipe. The inner hollow member 204 has an outer surface 210 and an inner surface 212. The inner surface 212 defines an inner void 214. The inner hollow member 204 has an upper section 216 and a lower section 218. The upper section 216 is a top portion of the casing. The lower section 218 is a bottom portion of the casing. The casing annulus pressure release system 100 is mechanically coupled between the upper section 216 and the lower section 218 within the outer hollow member 202 described later.

The casing annulus pressure release system 100 includes a controller 102, multiple sensors 104, and a pressure release sub-system 106. The controller 102 is configured to be disposed in the wellbore. The controller 102 is configured to receive signals from multiple sensors 104 and transmit control signals to the pressure release sub-system 106. The controller 102 can be a computer processor with a non-transitory computer-readable storage medium storing instructions executable by the computer processor to receive signals from multiple sensors 104 and transmit control signals to the pressure release sub-system 106. The computer processor is capable of performing operations to manage the annular pressure. The computer processor and each of its components are capable of operating within the wellbore under wellbore conditions and in the presence of well fluid. In some implementations, the controller 102 receives electrical power from a power source 108. For example, the power source 108 can be a battery. A battery can be lead acid or lithium ion. For example, electrical power can be conducted from the surface to the controller 102 by an electrical wire. An electrical cable 110 can connect the controller 102 to the power source 108. In some implementations, the electrical cable 110 provides power and signal communication between the controller 102 and the power source 108.

Multiple sensors 104 are configured to be disposed in the annular space defined by the outer hollow member inner surface 206 and the inner hollow member outer surface 210. Multiple sensors include a first sensor 104*a* and a second sensor 104*b*. Two sensors (first sensor 104*a* and second sensor 104*b*) are shown as examples, but additional sensors disposed at other locations are also possible. Multiple sensors 104 are operatively coupled to the controller 102. Multiple sensors 104 are configured to sense wellbore conditions in the annular space and transmit signals representing the sensed wellbore conditions to the controller 102. Wellbore conditions sensed by multiple sensors 104 can include pressure, temperature, and flow rate. Multiple sensors 104 can transmit signals to the controller 102 by multiple paths including Wi-Fi, radio, hydraulic, or electrical cables 110. In some implementations, multiple sensors 104 receive electrical power from the power source 108.

Figure 3A:
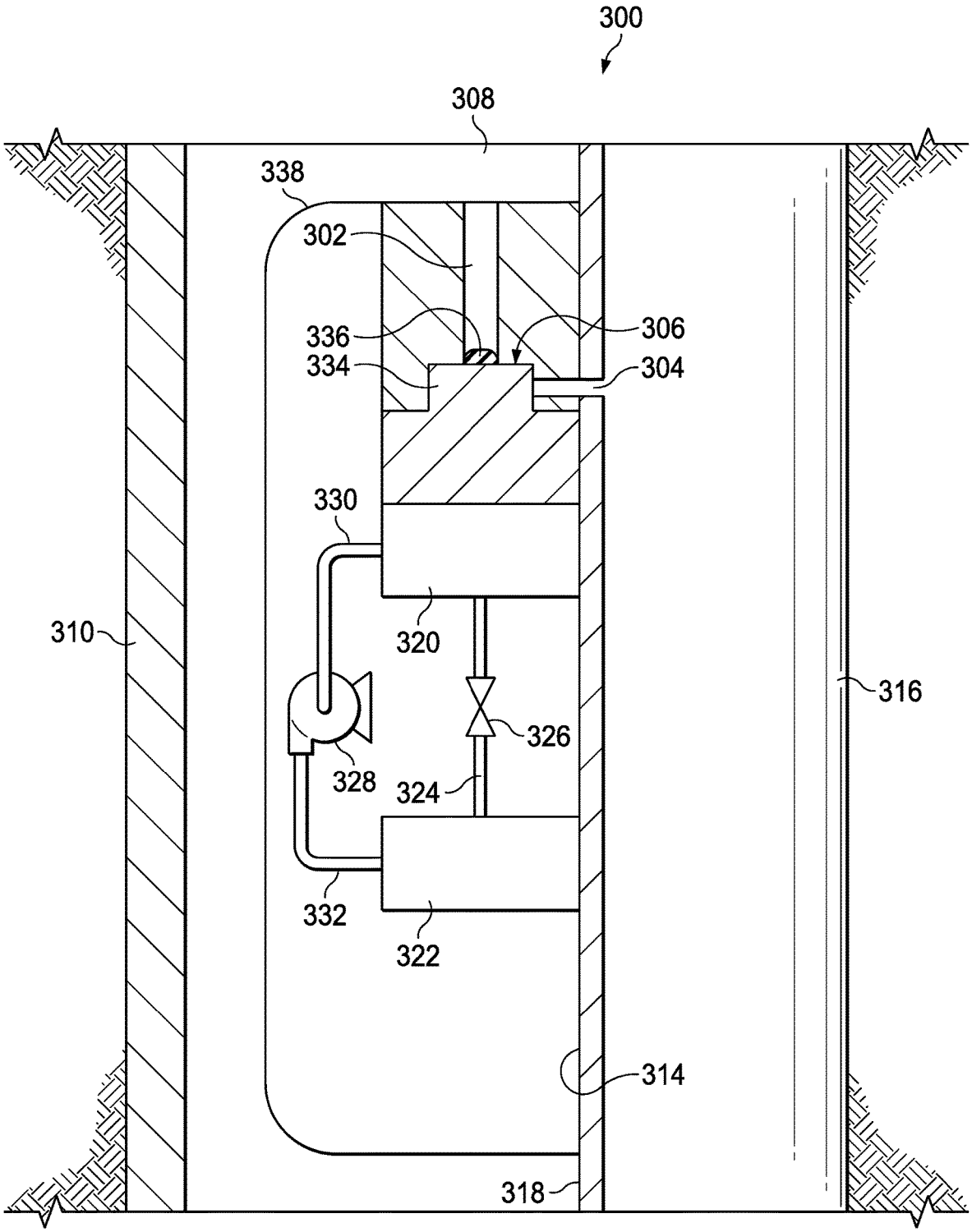
FIG. 3A is a detailed schematic view of the pressure release sub-system of FIG. 1 closed to prevent flow.
Figure 3B:
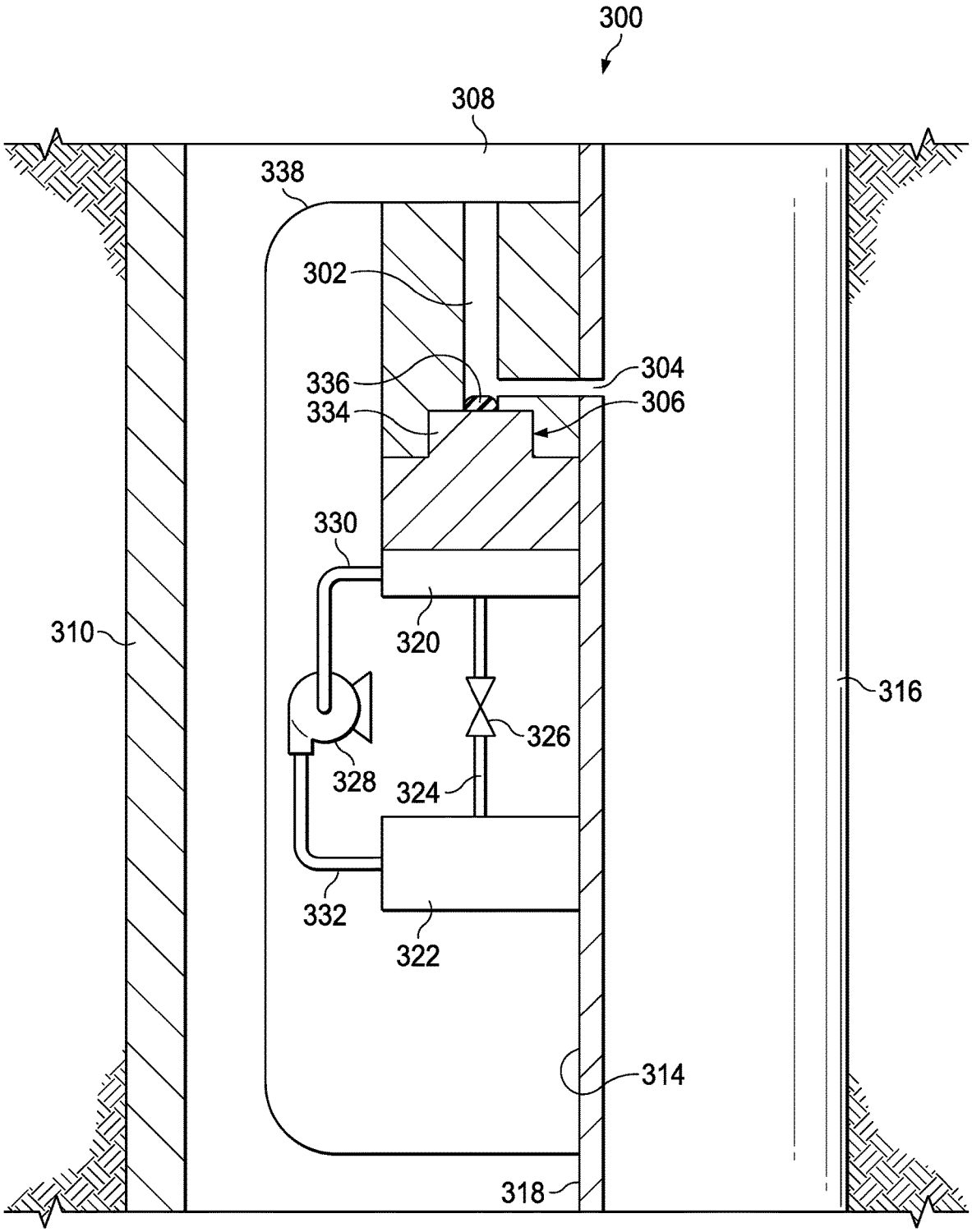
FIG. 3B is a detailed schematic view of the pressure release sub-system of FIG. 1 open to allow flow.

The pressure release sub-system 106 is configured to be disposed in the annular space defined by the outer hollow member inner surface 206 and the inner hollow member outer surface 210. The pressure release sub-system 106 is operatively coupled to the controller 102. The pressure release sub-system 106 is configured to receive signals from and transmit signals to the controller 102. The pressure release sub-system 106 can transmit signals to the controller 102 by multiple paths including Wi-Fi, radio, hydraulic, mechanical, or electrical cables 110. In some implementations, the pressure release sub-system 106 receives electrical power from the power source 108. The pressure release subsystem 106 is configured to release pressure in the annular space defined by the outer hollow member inner surface 206 and the inner hollow member outer surface 210 into the inner hollow member inner void 214 of the wellbore through a circumferential wall 220 of the inner hollow member 204 in response to a signal from the controller 102. The components and operational details of the pressure release sub-system 106 are shown in FIGS. 3A and 3B and described later.

In some implementations, the casing annulus pressure release system 100 is integrated into a casing joint. The casing annulus pressure release system 100 casing joint is mechanically coupled in between an upper section 216 casing and a lower section 218 casing by a mechanical connector 112. In some implementations, the mechanical connector 112 is a standard API (American Petroleum Institute) rotary shoulder pin connector. The standard API rotary shouldered connector is a regular connection, a numeric connection, an internal flush connection, or a full hole connection. In some implementations, the pin connection is manufacturer proprietary design. In some implementations, the mechanical connector 112 is a box connection, where the threads are internal to the box. The mechanical connector 112 can have an outer diameter corresponding to a standard American Petroleum Institute connection size. For example, the mechanical connector 112 can have an outer diameter of 4½ inches, 5½ inches, 6⅝ inches, 7 inches, 7⅝ inches, 8⅝ inches, 9⅝ inches, 10¾ inches, 11¾ inches, or 13⅜ inches.

Referring to FIG. 1, in some implementations, the controller 102, multiple sensors 104 and the pressure release sub-system 106 are positioned between the inner hollow member outer surface 210 and an outer enclosure 114. The outer enclosure 114 has an inner surface 116 which can be an inner surface of the casing joint. A first sensor 104 can be a pressure sensor. The first pressure sensor 104*a* is mechanically coupled to the inner surface 116 and senses the pressure in the annular space defined by the outer hollow member inner surface 206 and the inner hollow member inner surface 212. A second sensor 104*b* can be a pressure sensor. The second pressure sensor 104*b* is positioned within the outer enclosure 114 of the casing joint and directly contacts an inner hollow member outer surface 210 and senses the pressure in the annular space defined by the inner hollow member inner surface 212. In some implementations, the second pressure sensor 104*b* is positioned within the casing joint and directly contacts an inner surface of the casing joint corresponding to the inner hollow member inner surface 212. In some implementations, where the casing annulus pressure release system 100 is a casing joint coupling, the inner hollow member 204 and the outer hollow member 204, the controller 102, multiple sensors 104 and the pressure release subsystem 106 are positioned within the casing joint.

Figure 2:
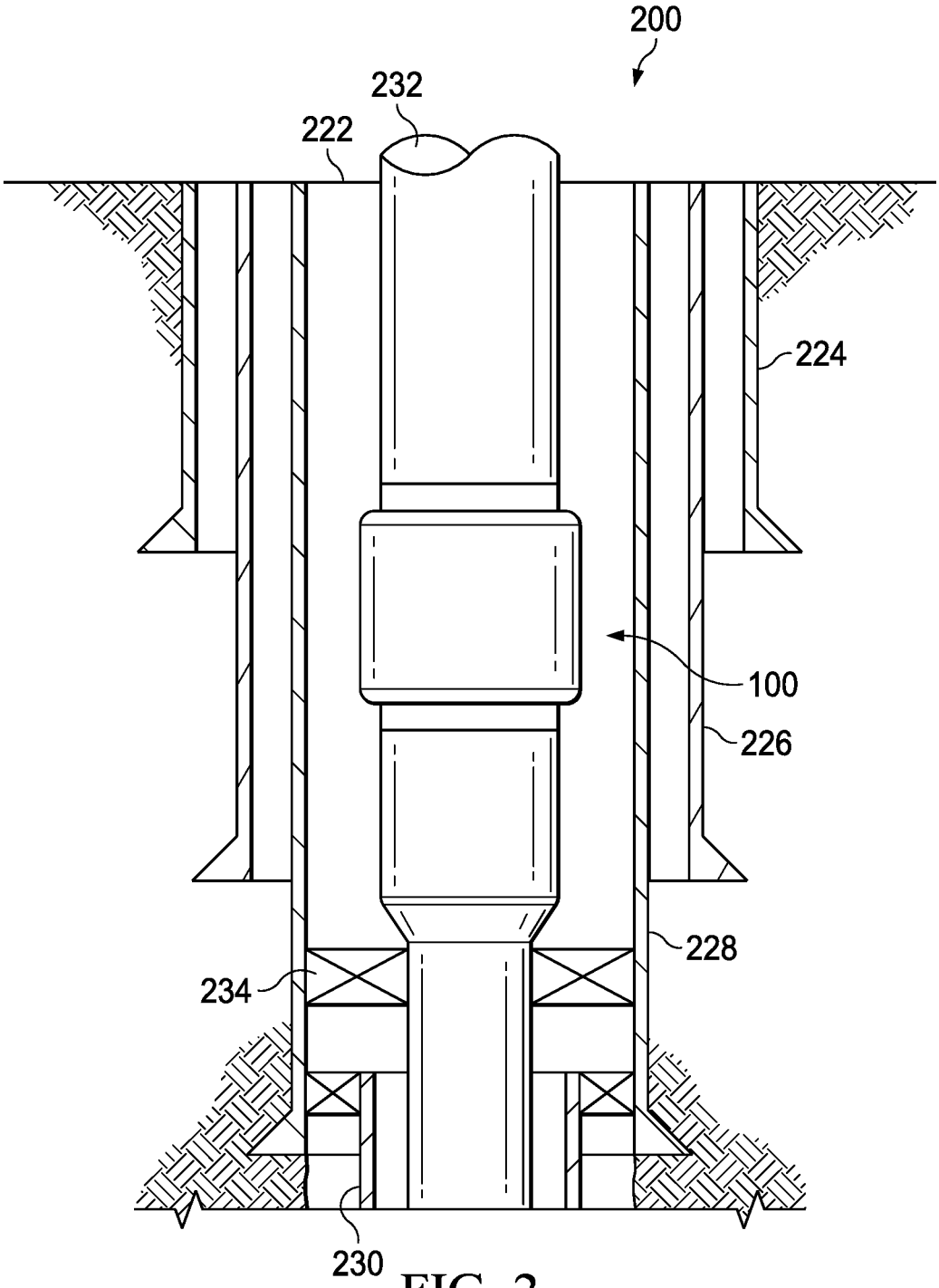
FIG. 2 is a schematic view of the casing annular pressure release system of FIG. 1 disposed within a wellbore.

FIG. 2 shows a schematic view of the casing annulus pressure release system 100 installed in the wellbore casing system 200 according to the implementations of the present disclosure. The wellbore casing system 200 extends to the surface 222 of the Earth. A surface casing 224 is mechanically coupled to the surface 222 of the Earth. An intermediate casing 226 is coupled to the surface 222 of the Earth and extends below the surface casing 224. A production casing 228 is coupled to the surface 222 of the Earth and extends below the surface casing 224 and the intermediate casing 226. In some implementations, a production liner 230 is mechanically attached downhole to the production casing 228. A production tubing 232 is coupled to the surface 222 of the Earth and extends below the surface casing 224, the intermediate casing 226, and the production casing 228. In some implementations, the production tubing 232 extends below the production liner 230. In some implementations, production packers 234 separate a wellbore in to multiple annular voids.

FIG. 2 shows the casing annulus pressure release system 100 installed in the wellbore casing system 200 in the production tubing 232. The casing annulus pressure release system 100 is mechanically coupled between the inner hollow member upper section 216 production tubing 232 and the inner hollow member lower section 218 production tubing 232 within the outer hollow member 202 production casing 228. In some implementations, the casing annulus pressure release system 100 is mechanically coupled between the inner hollow member upper section 216 production casing 228 and the inner hollow member lower section 218 production casing 228 within the outer hollow member 202 intermediate casing 226. In some implementations, the casing annulus pressure release system 100 is mechanically coupled between the inner hollow member upper section 216 intermediate casing 226 and the inner hollow member lower section 218 intermediate casing 226 within the outer hollow member 202 surface casing 224. In some implementations, each annular space can include its own casing annulus pressure release system 100. In other implementations, each annular space can include its own pressure release sub-system 106 and sensors 104, and have a common controller 102 that monitors annular pressure in all the annular spaces.

FIGS. 3A and 3B show detailed schematic views of the pressure release sub-system 300 of the casing annulus pressure release system 100 corresponding to the pressure release sub-system 106 according to the implementations of the present disclosure. Pressure release sub-system 300 disposed in the wellbore includes a first conduit 302, a second conduit 304, and a dual seal 306.

An outer hollow member 310 is disposed in the wellbore. In some implementations, the outer hollow member 310 is a casing or the Earth. For example, the outer hollow member 310 casing can be a surface casing, an intermediate casing, or a production casing. An inner hollow member 314 is disposed within the outer hollow member 310 creating an annular space 308. The inner hollow member 314 has an inner void 316. In some implementations, the inner hollow member 314 is a casing or a tubing. For example, the inner hollow member 314 can be an intermediate casing, a production casing or a production tubing.

The first conduit 302 is fluidically connected to the second conduit 304 on a first end and fluidically connect the annular space 308 on a second end. At least a portion of the first conduit 302 is formed in the circumferential wall of the outer enclosure 338 to fluidically connect the first conduit 304 to the annular space 308. The second conduit 304 is fluidically connected to the first conduit 302 on a first end and fluidically connected the inner void 316 on a second end. At least a portion of the second conduit 304 is formed in the circumferential wall of the inner hollow member 314 to fluidically connect the second conduit 304 to the inner void 316.

The dual seal 306 is positioned between the first conduit 302 and the second conduit 304. The dual seal 306 is configured to open or close fluid flow between the first conduit 302 and the second conduit 304. The dual seal 306 includes a metal-to-metal seal 334 and an elastomeric seal 336. The metal-to-metal seal 334 is configured to seal flow through the second conduit 304 and the elastomeric seal 336 is configured to seal flow through the first conduit 302 independently from each other. The elastomeric seal 336 seals the first conduit 302 while the metal-to-metal seal 334 seals the second conduit 304 such that even if one fails, the other maintains the seal, separating the first conduit 302 from the second conduit 304. The metal-to-metal seal 334 can be aluminum, nickel, steel, or an alloy. The elastomeric seal 336 can be constructed of rubber, nitrile rubber, or polyurethane.

A hydraulic fluid chamber 320 is fluidically coupled to the dual seal 306. The hydraulic fluid chamber 320 is configured to hold hydraulic fluid. The hydraulic fluid chamber 320 is also configured be flowed into or out of by hydraulic fluid. In some implementations, the hydraulic fluid chamber volume is expandable. Hydraulic fluid flows into the hydraulic fluid chamber 320 from a hydraulic fluid reservoir 322 described later. Hydraulic fluid flows out of the hydraulic fluid chamber 320 through the hydraulic pump 328 to the hydraulic fluid reservoir 322 described later. Hydraulic fluid flowing into the hydraulic fluid chamber 320 causes the dual seal to close, preventing flow from the first conduit 302 to the second conduit 304. Hydraulic fluid flowing out of the hydraulic fluid chamber 320 causes the dual seal to open, allowing from the first conduit to the second conduit. A hydraulic fluid reservoir 322 is fluidically coupled to the hydraulic fluid chamber 320 carrying hydraulic fluid by a third conduit 324. A check valve 326 is interposed between the hydraulic fluid chamber 320 and the hydraulic fluid reservoir 324 in the third conduit 324. The check valve 326 prevents flow from the hydraulic fluid chamber 320 to the hydraulic fluid reservoir 322, maintaining the dual seal 306 in the closed position, preventing flow from the first conduit 302 to the second conduit 304 (FIG. 3A). The check valve 326 allows flow from the hydraulic fluid reservoir 322 to the hydraulic fluid chamber 320, moving the dual seal 306 to the closed position, stopping flow from the first conduit 302 to the second conduit 304 (FIG. 3A).

A hydraulic pump 328 is fluidically connected to the hydraulic fluid chamber 320 and the hydraulic fluid reservoir 322 and operatively controlled by the controller 102. The hydraulic pump 328 pumps hydraulic fluid when directed to by the controller 102. The hydraulic pump 328 stops pumping hydraulic fluid when directed to by the controller 102. The hydraulic pump 328 has a suction port 330 and a discharge port 332. The hydraulic pump 328 suction port 330 is fluidically connected to the hydraulic fluid chamber. The hydraulic pump 328 discharge port 332 is fluidically coupled to the hydraulic fluid reservoir 322. The hydraulic pump 328 is configured to move hydraulic fluid from the hydraulic fluid chamber 320 to the hydraulic fluid reservoir 322, opening the dual seal 306. The hydraulic fluid chamber 320 is configured to be flexible to set a threshold annular pressure at or above which the hydraulic pump 328 flows hydraulic fluid from the hydraulic fluid chamber 320 to the hydraulic fluid reservoir 322, opening the dual seal 306 to open fluid flow between the first conduit 302 and the second conduit 304 and below which the hydraulic pump 328 and the check valve 326 are configured to prevent fluid exiting the hydraulic fluid chamber 320, moving the dual seal 306 to the closed position, stopping fluid flow between the first conduit 302 and the second conduit 304.

The pressure release sub-system 300 is surrounded by the outer enclosure 338. The outer enclosure 338 can be unitarily formed by the casing or a separate body mechanically attached to the casing.

Figure 4:
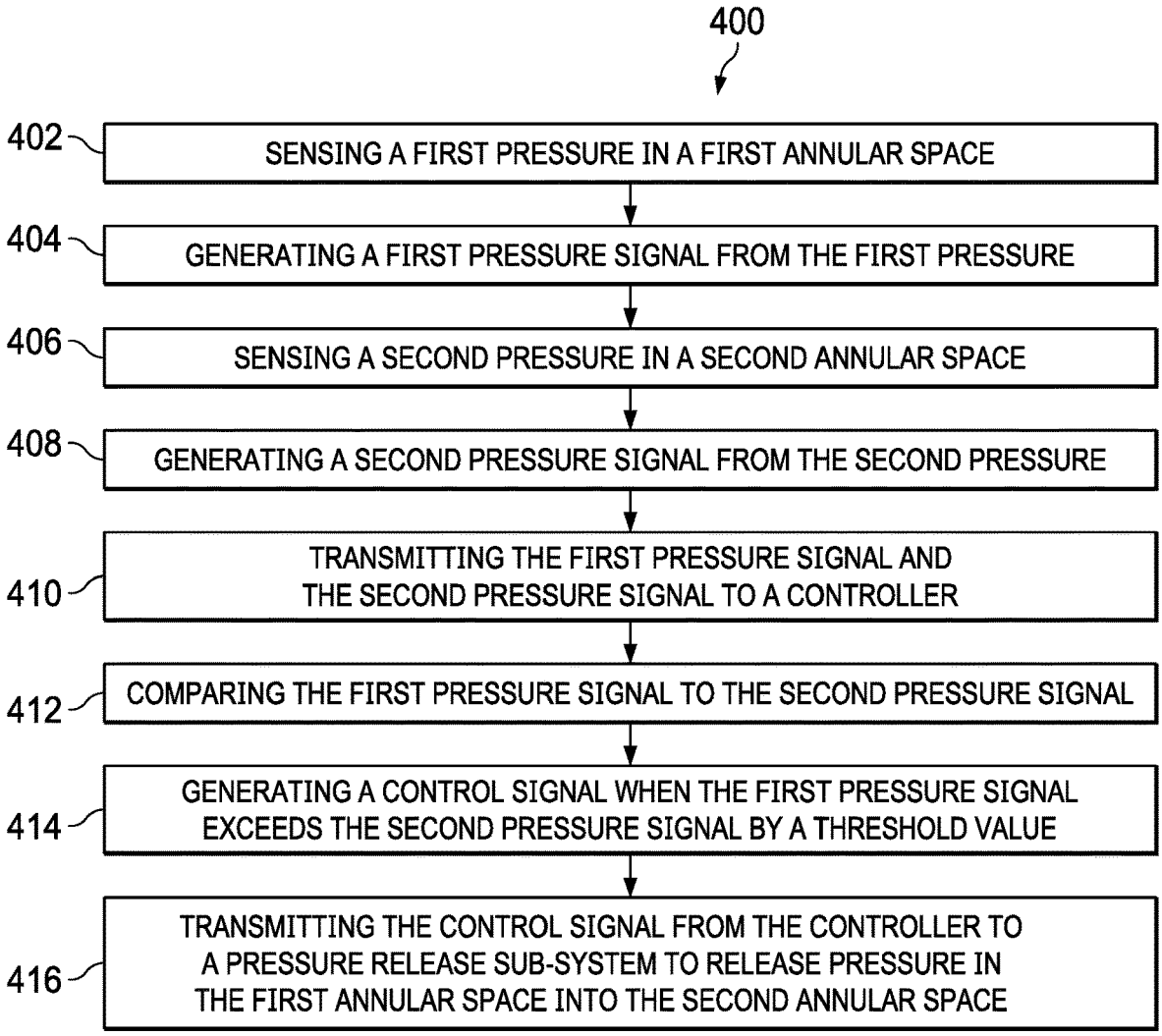
FIG. 4 is a flow chart of an example method of releasing pressure in a casing annulus according to implementations of the present disclosure.

FIG. 4 is a flow chart of an example method of releasing pressure in a casing annulus according to the implementations of the present disclosure. This method includes sensing a first pressure in a first annular space defined by an inner hollow member of a wellbore within an outer hollow member of the wellbore (402). This method includes generating a first pressure signal from the first pressure (404). This method includes sensing a second pressure in a second annular space defined by the inner hollow member of the wellbore (406). This method includes generating a second pressure signal from the second pressure (408). This method includes transmitting the first pressure signal and the second pressure signal to a controller within the wellbore (410). This method includes comparing the first pressure signal to the second pressure signal with the controller (412). This method includes generating a control signal when the first pressure signal exceeds the second pressure signal by a threshold value (414). This method includes transmitting the control signal from the controller to a pressure release sub-system configured to release pressure in the first annular space into the second annular space through a circumferential wall of the inner casing (416).

Figure 5:
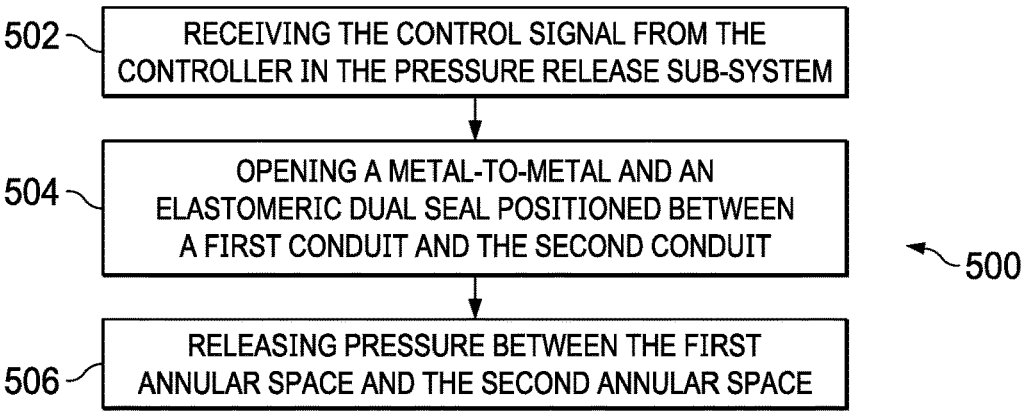
FIG. 5 is a flow chart of an example method of releasing pressure in a casing annulus with a dual seal according to implementations of the present disclosure.

FIG. 5 is a flow chart of an example method of releasing pressure in a casing annulus with a dual seal according to the implementations of the present disclosure. This method includes receiving the control signal from the controller in the pressure release sub-system (502). This method includes opening a dual seal positioned between a first conduit fluidically coupled to the first annular space and the second conduit fluidically coupled to the second annular space, the dual seal configured to open or close fluid flow between the first conduit and the second conduit, wherein the dual seal comprises a metal-to-metal seal and an elastomeric seal, wherein the metal-to-metal seal is configured to seal flow through the second conduit and the elastomeric seal is configured to seal flow through the first conduit independently from each other (504). This method includes releasing pressure between the first annular space and the second annular space (506).

Referring to FIGS. 1, 3A, and 3B, releasing pressure of an annular space is accomplished by a pressure release system including a first conduit 302, a second conduit 304, a dual seal 306, a hydraulic fluid chamber 320, and a hydraulic fluid reservoir 322. The first conduit 302 fluidically connects a first annular space 308 defined by an outer casing 310 of a wellbore to an internal volume defined by a casing joint. The second conduit 304 fluidically connects a second annular space 318 defined by an inner casing to an internal volume defined by the outer casing, where a portion of the second conduit 304 formed in the circumferential wall of the inner casing. The dual seal 306 is positioned between the first conduit 302 and the second conduit 304. The dual seal 306 is configured to open or close fluid flow between the first conduit 302 and the second conduit 304. The dual seal 306 includes a metal-to-metal seal 334 and an elastomeric seal 336. The metal-to-metal seal 334 is configured to seal flow through the second conduit 304 and the elastomeric seal 336 is configured to seal flow through the first conduit 302 independently from each other. The hydraulic fluid chamber 320 is configured to allow flow hydraulic fluid into or out of itself, to close or open respectively, the dual seal. The hydraulic fluid reservoir 332 is coupled to the hydraulic fluid chamber 320 by a third conduit 324. The third conduit 324 has a check valve 326. The check valve 326 is configured to maintain closed or to close fluid flow between the first conduit 302 and the second conduit 304 responsive to the signal from the controller 102. The third conduit 324 carries hydraulic fluid. The hydraulic fluid reservoir 322 is configured to flow the hydraulic fluid through the third conduit 324 and the check valve to the hydraulic fluid chamber 320 in response to a signal to cause the hydraulic fluid chamber 302 to close the dual seal 306, shutting the fluid flow, respectively, between the first conduit 302 and the second conduit 304. In some implementations, a hydraulic pump 328 is fluidically coupled to the hydraulic fluid reservoir 322 and the hydraulic fluid chamber 320. The hydraulic pump 328 is configured to move hydraulic fluid from the hydraulic fluid chamber 320 to the hydraulic fluid reservoir 322, opening the dual seal 306. In some implementations, the hydraulic fluid chamber 320 is flexible to set a threshold annular pressure at or above which the hydraulic pump 328 is configured to open fluid flow between the first conduit 302 and the second conduit 304 and below which the check valve 326 is configured to close fluid flow between the first conduit 302 and the second conduit 304.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations. For example, the implementations are described with reference to a tee pipe fitting. However, the disclosure can be implemented with any appropriate pipe fitting that connects two or more pipes flowing fluids of different pressures.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, or to about another particular value or a combination of them. When such a range is expressed, it is to be understood that another implementation is from the one particular value or to the other particular value, along with all combinations within said range or a combination of them.

Throughout this application, where patents or publications are referenced, the disclosures of these references in their entireties are intended to be incorporated by reference into this application, in order to more fully describe the state of the art to which the disclosure pertains, except when these references contradict the statements made herein.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

The invention claimed is:

1. A casing annulus pressure release system comprising:

a controller configured to be disposed in an annular space defined by positioning an inner hollow member of a wellbore within an outer hollow member of the wellbore;

a plurality of sensors configured to be disposed in the annular space, the plurality of sensors operatively coupled to the controller, the plurality of sensors configured to sense wellbore conditions in the annular space and transmit signals representing the sensed wellbore conditions to the controller;

a pressure release sub-system configured to be disposed in the annular space, the pressure release sub-system operatively coupled to the controller, the pressure release sub-system configured to release pressure in the annular space into the inner hollow member of the wellbore through a circumferential wall of the inner hollow member responsive to a signal from the controller; and a casing joint coupling the inner hollow member and the outer hollow member, the controller, the plurality of sensors and the pressure release sub-system positioned within the casing joint.

2. The system of claim 1, wherein the inner hollow member is a casing and the outer hollow member is the wellbore.

3. The system of claim 1, wherein the inner hollow member is an inner casing and the outer hollow member is an outer casing.

4. The system of claim 1, wherein the controller, the plurality of sensors, and the pressure release sub-system are positioned between an outer surface of the inner hollow member and an inner surface of the casing joint.

5. The system of claim 1, wherein the plurality of sensors comprises a first pressure sensor configured to measure a pressure inside the outer hollow member.

6. The system of claim 5, wherein the first pressure sensor is positioned within the casing joint and directly contacts an outer surface of the inner hollow member.

7. The system of claim 1, wherein the plurality of sensors comprises a second pressure sensor configured to measure an annular pressure in the annular space.

8. The system of claim 7, wherein the second pressure sensor is positioned within the casing joint directly contacts an inner surface of the casing joint.

9. The system of claim 1, further comprising a power source configured to power the controller.

10. The system of claim 1, wherein the pressure release sub-system comprises:

a first conduit fluidically connecting the annular space to an internal volume defined by the casing joint;

a second conduit fluidically connecting the annular space the internal volume defined by the casing joint to an internal volume defined by the inner hollow member, at least a portion of the second conduit formed in the circumferential wall of the inner hollow member; and a dual seal positioned between the first conduit and the second conduit, the dual seal configured to open or close fluid flow between the first conduit and the second conduit.

11. The system of claim 10, wherein the pressure release sub-system comprises a hydraulic fluid chamber, wherein to close or open the dual seal, a hydraulic fluid is configured to be flowed into or out of, respectively, the hydraulic fluid chamber.

12. The system of claim 11, wherein the pressure release sub-system comprises:

a hydraulic fluid reservoir fluidically coupled to the hydraulic fluid chamber by a third conduit, the hydraulic fluid reservoir configured to flow the hydraulic fluid to the hydraulic fluid chamber through the third conduit, the third conduit having a check valve configured to prevent back flow, wherein flowing hydraulic fluid causes the dual seal to close; and a hydraulic pump fluidically coupled to the hydraulic fluid reservoir and the hydraulic fluid chamber, the hydraulic pump configured to move hydraulic fluid from the hydraulic fluid chamber to the hydraulic fluid reservoir, opening the dual seal.

13. The system of claim 12, wherein the hydraulic fluid chamber is configured to be flexible to set a threshold annular pressure at or above which the hydraulic pump is configured to flow hydraulic fluid from the hydraulic fluid chamber to the hydraulic fluid reservoir, opening the dual seal to open fluid flow between the first conduit and the second conduit and below which the hydraulic pump and the check valve are configured to prevent fluid exiting the hydraulic fluid chamber, stopping fluid flow between the first conduit and the second conduit.

14. The system of claim 10, wherein the dual seal comprises a metal-to-metal seal and an elastomeric seal, wherein the metal-to-metal seal is configured to seal flow through the second conduit and the elastomeric seal is configured to seal flow through the first conduit independently from each other.

15. A method comprising:

sensing a first pressure in a first annular space defined by an inner hollow member of a wellbore within an outer hollow member of the wellbore;

generating a first pressure signal from the first pressure;

sensing a second pressure in a second annular space defined by the inner hollow member of the wellbore;

generating a second pressure signal from the second pressure;

transmitting the first pressure signal and the second pressure signal to a controller within the wellbore;

comparing the first pressure signal to the second pressure signal with the controller;

generating a control signal when the first pressure signal exceeds the second pressure signal by a threshold value;

transmitting the control signal from the controller to a pressure release sub-system configured to release pressure in the first annular space into the second annular space through a circumferential wall of the inner hollow member;

receiving the control signal from the controller in the pressure release sub-system;

opening a dual seal positioned between a first conduit fluidically coupled to the first annular space and a second conduit fluidically coupled to the second annular space, the dual seal configured to open or close fluid flow between the first conduit and the second conduit, wherein the dual seal comprises a metal-to-metal seal and an elastomeric seal, wherein the metal-to-metal seal is configured to seal flow through the second conduit and the elastomeric seal is configured to seal flow through the first conduit independently from each other; and releasing pressure between the first annular space and the second annular space.

16. A pressure release system comprising:

a first conduit fluidically connecting a first annular space defined by an outer casing of a wellbore to an internal volume defined by a casing joint;

a second conduit fluidically connecting a second annular space defined by an inner casing, the internal volume defined by the casing joint to an internal volume defined by the inner casing, at least a portion of the second conduit formed in a circumferential wall of the inner casing;

a dual seal positioned between the first conduit and the second conduit, the dual seal configured to open or close fluid flow between the first conduit and the second conduit, wherein the dual seal comprises a metal-to-metal seal and an elastomeric seal, wherein the metal-to-metal seal is configured to seal flow through the second conduit and the elastomeric seal is configured to seal flow through the first conduit independently from each other;

a hydraulic fluid chamber, wherein to close or open the dual seal, a hydraulic fluid from the hydraulic fluid chamber is configured to be flowed into or out of, respectively; and a hydraulic fluid reservoir coupled to the hydraulic fluid chamber by a third conduit, the third conduit with a check valve, the check valve configured to maintain closed or close fluid flow between the first conduit and the second conduit responsive to the signal from the controller, the third conduit carrying the hydraulic fluid, the hydraulic fluid reservoir configured to flow the hydraulic fluid to the check valve responsive to a signal to cause the check valve to close the fluid flow between the first conduit and the second conduit.

17. The system of claim 16, further comprising a hydraulic pump fluidically coupled to the hydraulic fluid reservoir and the hydraulic fluid chamber, the hydraulic pump configured to move hydraulic fluid from the hydraulic fluid reservoir and the hydraulic fluid chamber, opening the dual seal.

18. The system of claim 16, wherein the hydraulic fluid chamber is flexible to set a threshold annular pressure at or above which the hydraulic pump is configured to open fluid flow between the first conduit and the second conduit and below which the check valve is configured to close fluid flow between the first conduit and the second conduit.

* * * * *